US010480449B2

(12) United States Patent
Miura et al.

(10) Patent No.: US 10,480,449 B2
(45) Date of Patent: Nov. 19, 2019

(54) CYLINDER HEAD OF ENGINE

(71) Applicant: TOYOTA JIDOSHA KABUSHIKI KAISHA, Toyota-shi (JP)

(72) Inventors: Takeshi Miura, Nisshin (JP); Kunihiko Sakata, Nagakute (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 17 days.

(21) Appl. No.: 15/880,578

(22) Filed: Jan. 26, 2018

(65) Prior Publication Data

US 2018/0223768 A1 Aug. 9, 2018

(30) Foreign Application Priority Data

Feb. 6, 2017 (JP) ..... 2017-019220

(51) Int. Cl.
*F02F 1/40* (2006.01)
*F02F 1/24* (2006.01)

(52) U.S. Cl.
CPC ..... *F02F 1/40* (2013.01); *F02F 1/242* (2013.01)

(58) Field of Classification Search
CPC ..... F01P 3/02; F01P 3/16; F01P 3/14
See application file for complete search history.

(56) References Cited

U.S. PATENT DOCUMENTS

| | | | | |
|---|---|---|---|---|
| 9,422,886 | B2 * | 8/2016 | Farooqui | F01L 3/02 |
| 2002/0124815 | A1 * | 9/2002 | Ishiguro | F02F 1/242 123/41.82 R |
| 2004/0139933 | A1 * | 7/2004 | Obermayer | F01P 3/16 123/41.82 R |
| 2004/0200444 | A1 * | 10/2004 | Sugano | F02F 1/40 123/41.82 R |
| 2005/0145204 | A1 * | 7/2005 | Iida | F01P 3/16 123/41.31 |
| 2016/0195035 | A1 * | 7/2016 | Poschl | F01P 3/14 123/41.77 |

FOREIGN PATENT DOCUMENTS

| | | |
|---|---|---|
| JP | 61-255247 A | 11/1986 |
| JP | 2003-301743 | 10/2003 |
| JP | 2015-113705 A | 6/2015 |

* cited by examiner

*Primary Examiner* — Long T Tran
(74) *Attorney, Agent, or Firm* — Oblon, McClelland, Maier & Neustadt, L.L.P.

(57) ABSTRACT

A cylinder head includes a pair of intake ports and a pair of exhaust ports disposed to face each other and disposed to surround a fuel injection valve, a first coolant path through which coolant flows from a position between the intake ports toward the fuel injection valve, a second coolant path through which coolant flows from a position between the exhaust ports toward the fuel injection valve, and a junction. The junction includes a facing wall that extends from a top surface of the junction toward the combustion chamber disposed on a lower side of the top surface and that faces a flow of coolant in at least one of the first and second coolant paths.

8 Claims, 6 Drawing Sheets

CYLINDER HEAD OF ENGINE

INCORPORATION BY REFERENCE

The disclosure of Japanese Patent Application No. 2017-019220 filed on Feb. 6, 2017 including the specification, drawings and abstract is incorporated herein by reference in its entirety.

BACKGROUND

1. Technical Field

The present disclosure relates to the structure of a cylinder head of an engine and particularly relates to the structure of a water jacket in a cylinder head in which a pair of intake ports and a pair of exhaust ports (two intake ports and two exhaust ports) are provided for each cylinder.

2. Description of Related Art

In the related art, an engine of a vehicle is generally provided with water jackets through which coolant flows in order to cool a cylinder head or a cylinder block that is heated to a relatively high temperature due to heat received from a combustion chamber in a cylinder. Generally, coolant that is supplied from a radiator outside the engine via a water hose flows into a water jacket of the cylinder block first. Thereafter, the coolant flows into a water jacket of the cylinder head.

In order to efficiently cool a cylinder head with coolant flowing into the water jackets as described above, a diesel engine described in for example, Japanese Unexamined Patent Application Publication No. 2003-301743 (JP 2003-301743 A) is provided with a first coolant path through which coolant flows from a position between a pair of intake ports to a fuel injection nozzle that is disposed along the central line of a cylinder and a second coolant path through which coolant flows from a position between a pair of exhaust ports to the fuel injection nozzle.

The first and second coolant paths join each other after branching such that the first coolant path and the second coolant path surround the fuel injection nozzle. The vicinity of the fuel injection nozzle is cooled at a junction of the first and second coolant paths and coolant is fed from the junction to positions between the intake ports and the exhaust ports. The first and second coolant paths are integrally formed with each other by using aluminum alloy pipes that are cast when the cylinder head is cast.

SUMMARY

However, in an example described in JP 2003-301743 A, since coolant rising from a water jacket of a cylinder block flows into the first and second coolant paths as illustrated in FIG. 3 of JP 2003-301743 A, the flows of coolant are likely to become one-sided toward an upper side in the coolant paths and the flows of coolant are likely to become stagnant in a lower side in the coolant paths. The flows of coolant from an intake side and an exhaust side that are one-sided toward the upper side in the coolant paths are divided into right and left sides after colliding with each other in the vicinity of the fuel injection nozzle and proceed in a direction in which cylinders are arranged.

That is, in the case of the related art, coolant flows to the vicinity of the central portion of a cylinder to which a relatively high thermal load is applied but the flows of coolant are unlikely to reach a bottom surface (combustion chamber side) of the water jacket that is most desired to be cooled. Therefore, in the case of a direct injection type diesel engine as in the related art, a thermal load applied to a cylinder head may not be sufficiently reduced. In addition, in the case of a direct injection type gasoline engine, knocking is likely to occur due to an increase in temperature of a combustion chamber and the temperature of an injector becomes relatively high, which results in a high possibility of a deposit accumulated in an injection hole of the injector.

The disclosure provides a cylinder head of an engine with which it is possible to direct a flow of coolant toward a combustion chamber side and to efficiently cool the combustion chamber side with an elaborately designed configuration of a junction of first and second coolant paths through which coolant flows toward the vicinity of the center of a cylinder.

An aspect relates to a cylinder head including a pair of intake ports, a pair of exhaust ports, a first coolant path, and a second coolant path. The intake ports and the exhaust ports are opened toward a combustion chamber for each of cylinders in an engine. Coolant flows through the first coolant path from a position between the intake ports toward a fuel injection valve. Coolant flows through the second coolant path from a position between the exhaust ports toward the fuel injection valve. The intake ports and the exhaust ports are disposed to face each other and the intake ports and the exhaust ports are disposed to surround a fuel injection valve.

In this case, the first coolant path is branched into first branch portions to surround the fuel injection valve, and the second coolant path is branched into second branch portions to surround the fuel injection valve. The cylinder head is provided with a junction in which downstream side portions of the first branch portion of the first coolant path and the second branch portion of the second coolant path. The junction includes a facing wall that extends from a top surface of the junction toward the combustion chamber disposed on a lower side and that faces a flow of coolant in at least one of the first branch portion of the first coolant path and the second branch portion of the second coolant path. The expressions "a top surface", "toward the combustion chamber disposed on a lower side of the top surface", and the like are based on an assumption that a direction along a central line of a cylinder in which a piston reciprocates is referred to as a vertical direction. However, this is not intended to limit a direction or an orientation at the time of actual use.

In the cylinder head configured as described above, the coolant flows through the first coolant path from the position between the intake ports toward the fuel injection valve for each cylinder and the coolant flows through the second coolant path from the position between the exhaust ports toward the fuel injection valve for each cylinder. In addition, a flow of coolant from an intake side and a flow of coolant from an exhaust side join each other while efficiently cooling the fuel injection valve on a downstream side at which each of the coolant paths branches.

The junction in which the flows join each other as described above is provided with the facing wall that extends from the top surface of the junction toward the combustion chamber disposed on the lower side of the top surface and a flow of coolant from at least one of the intake side and the exhaust side is directed downwards after colliding with the facing wall. When a flow of coolant from one of the intake side and the exhaust side is directed downwards, a flow of coolant from the other one of the intake side and the exhaust side is directed downwards due to the flow of coolant and the flows of coolant from both of the intake side and the exhaust side reach a bottom surface of the junction. Therefore, it is possible to efficiently cool the bottom surface of the junction.

The flows of coolant in the first branch portion of the first coolant path and the second branch portion of the second coolant path may be directed downwards after respectively colliding with side surfaces of the facing wall that are on the intake side and the exhaust side. In this case, since the flows of coolant from both of the intake side and the exhaust side are directed downwards by the facing wall, a larger amount of coolant is able to reach the bottom surface of the junction. Therefore, it is possible to more efficiently cool the bottom surface of the junction.

In the cylinder head according to the aspect, the junction of the first branch portion of the first coolant path and the second branch portion of the second coolant path may include a guiding wall that surrounds at least a portion of the junction from a side opposite to the fuel injection valve side and that guides the flow of coolant in at least one of the first branch portion of the first coolant path and the second branch portion of the second coolant path toward the facing wall. According to the aspect, a flow of coolant from at least one of the intake side and the exhaust side can be guided toward the facing wall by the guiding wall while being restrained from escaping to right and left sides, and thus the amount of coolant being directed to flow downwards becomes large.

In the cylinder head according to the aspect, the guiding wall may be provided to extend downwards from the top surface of the junction and a downstream side end portion of the guiding wall that is positioned on a downstream side in a direction in which coolant in at least one of the first branch portion of the first coolant path and the second branch portion of the second coolant path flows may be connected to the facing wall. According to the aspect, a flow of coolant that collides with the facing wall as described above can be directed downwards without escaping from a space between the facing wall and the guiding wall and thus the amount of coolant flowing downwards is increased.

However, when the flow of coolant is restrained from escaping from a space between the facing wall and the guiding wall by being surrounded by the facing wall and the guiding wall, there is a possibility of an increase in pressure loss. Therefore, in the cylinder head according to the aspect, a gap may be formed between an upstream side end portion of the guiding wall that is on a side opposite to the downstream side end portion side and a peripheral wall of the intake port or the exhaust port such that the coolant flows along the peripheral wall.

According to the aspect, a flow of coolant in at least one of the first branch portion of the second coolant path and the second branch portion of the second coolant path is guided toward the facing wall by the guiding wall as described above. In addition, since a portion of the flow of coolant flows through the gap between the guiding wall and the peripheral wall along the peripheral wall and escapes to right and left sides, it is possible to suppress the increase in pressure loss as described above. Therefore, it is possible to achieve an improvement in cooling properties and to suppress an increase in pressure loss accompanying the improvement in cooling properties at the same time by appropriately adjusting the size of the gap.

In the cylinder head according to the aspect, a sectional area of the second branch portion of the second coolant path in the junction may be larger than a sectional area of the first branch portion of the first coolant path in the junction.

In the cylinder head according to the aspect, an intake side portion of the top surface of the junction may be lower than an exhaust side portion of the top surface and a side wall that connects the intake side portion and the exhaust side portion may face a flow of coolant in the second coolant path. According to the aspect, there is an advantage that stagnation due to collision between the flows of coolant is unlikely to occur and since it is possible to reliably cool the fuel injection valve on the exhaust side of which the temperature is likely to become relatively high, the aspect is particularly favorable for a case where an ignition plug is disposed to be close to an exhaust side of the fuel injection valve.

When the sectional area of the second coolant path on the exhaust side is set to be larger than the sectional area of the first coolant path on the intake side in this case, the amount of coolant flowing from the exhaust side that is directed downwards after colliding with the facing wall is increased and thus a more intensive downward flow can be formed. Coolant having a relatively low temperature preferably flows into the first and second coolant paths from a water jacket of the cylinder block in a direct manner.

As described above, in the cylinder head of an engine according to the aspect, coolant from the intake side and the exhaust side flows toward the fuel injection valve disposed in the vicinity of the center of each of the cylinders through the first and second coolant paths and thus the vicinity of the fuel injection valve can be efficiently cooled. Since at least one of flows of coolant from the intake side and the exhaust side is directed downwards after colliding with the facing wall in the junction of the coolant paths, the flow of coolant can reach the bottom surface of the junction and it is possible to efficiently cool the bottom surface of the junction.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
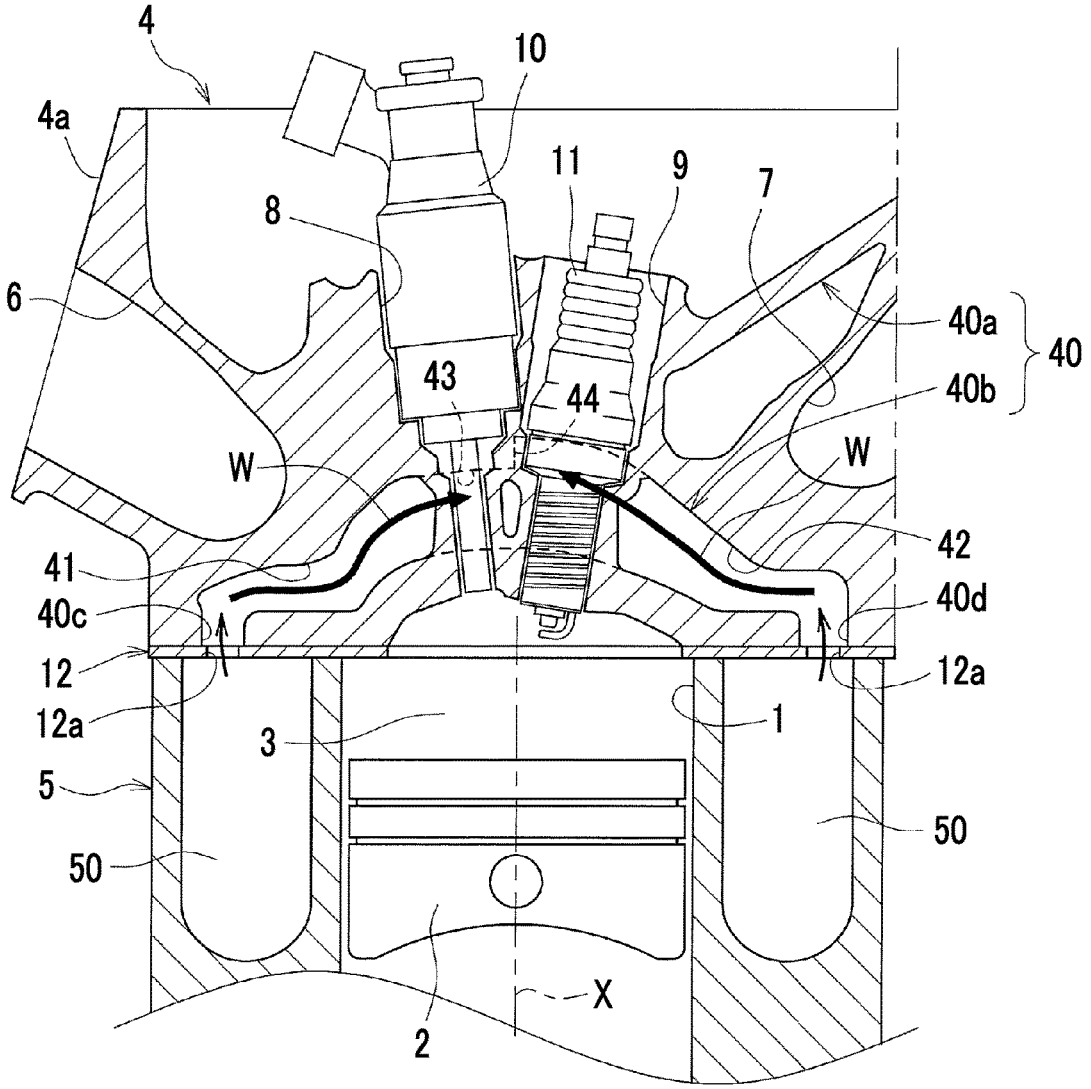
FIG. 1 is an explanatory view that illustrates a section of a portion of a cylinder head according to an embodiment and illustrates a configuration in the vicinity of a cylinder in an engine.
Figure 2:
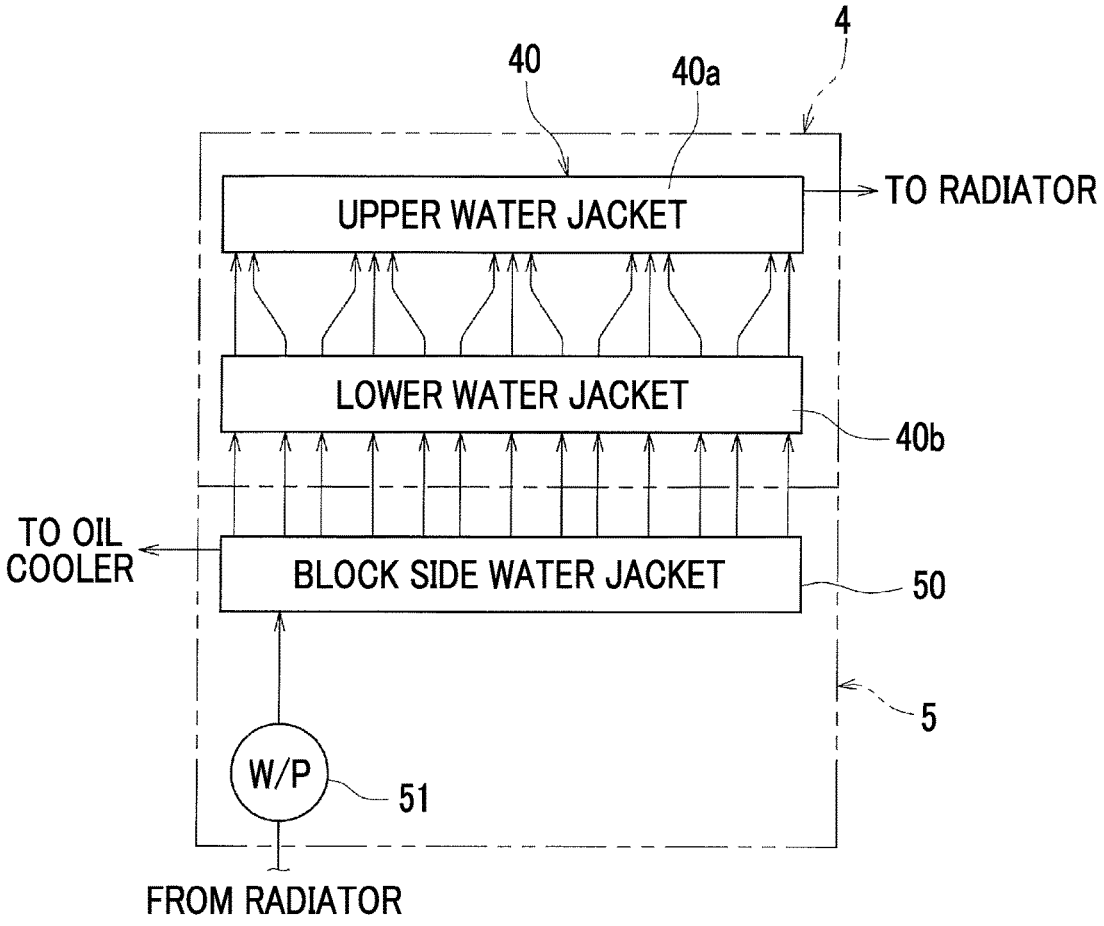
FIG. 2 is an explanatory diagram that schematically illustrates an engine cooling system.

Hereinafter, an embodiment that is applied to a multi-cylinder gasoline engine installed in a vehicle will be described as an example. FIG. 1 schematically illustrates a portion of a configuration of a gasoline engine (entire configuration is not shown) that is in the vicinity of a cylinder 1, and a combustion chamber 3 is formed above a piston 2 accommodated in each cylinder 1. That is, as schematically illustrated in FIG. 2, a cylinder head 4 is assembled with an upper portion of a cylinder block 5 and closes the upper end of the cylinder 1 formed in the cylinder block 5.

The expressions "above a piston 2", "an upper portion of a cylinder block 5", and the like are based on an assumption that a top dead center side in a direction along a central line X of the cylinder 1 in which the piston 2 reciprocates will be referred to as an upper side and a bottom dead center side will be referred to as a lower side, for convenience of description. In the following description, the direction may be simply referred to as a vertical direction. However, this is not intended to limit a direction or an orientation at the time of actual use.

A shallow recess that serves as a top portion of the combustion chamber 3 for each cylinder 1 is formed on a lower surface of the cylinder head 4 that closes the upper end of the cylinder 1 as described above. In an example illustrated in FIG. 1, the shape of the recess is a gently sloping triangular roof-shape formed by two inclined surfaces on an intake side and an exhaust side. A pair of intake ports 6 (one of intake ports 6 is illustrated in FIG. 1) arranged in a transverse direction is opened on an inclined surface on the intake side out of the two inclined surfaces, that is, an inclined surface on the left side in FIG. 1.

A lower end opening portion of each intake port 6 that is opened toward the combustion chamber 3 as described above is opened and closed by an intake valve (not shown). Each intake port 6 extends obliquely upwards from the lower end opening portion and the upper end of each intake port 6 is opened on a flange surface 4*a* of the cylinder head 4 that is provided on the intake side (left side in FIG. 1). An intake manifold (not shown) is attached to the flange surface 4*a* and an intake path inside the intake manifold communicates with the intake ports 6.

Meanwhile, as illustrated in the right side in FIG. 1, a pair of exhaust ports 7 (one of exhaust ports 7 is illustrated in FIG. 1) arranged in the transverse direction is opened on an inclined surface of the top portion of the combustion chamber 3 that is on the exhaust side and each of the exhaust ports 7 is opened or closed by an exhaust valve (not shown). Although not illustrated, the exhaust ports 7 extending obliquely upwards from lower end opening portions thereof are opened on a side surface of the cylinder head 4 that is on the exhaust side after joining each other. In the embodiment, the cylinder head 4 is integrated with an exhaust manifold.

An injector hole 8 and a plug hole 9 are opened in the vicinity of the center of the top portion of the combustion chamber 3 such that the injector hole 8 and the plug hole 9 are surrounded by the lower end opening portions of the intake ports 6 and the exhaust ports 7. An injector 10 (fuel injection valve) is accommodated in the injector hole 8 and a tip end portion of the injector 10 faces the combustion chamber 3. Although not illustrated, a fuel distribution pipe shared by the cylinders 1 is connected to a base end portion (upper end portion) of the injector 10 such that fuel pressure-fed from a high-pressure fuel pump is distributed to the injector 10.

Meanwhile, an ignition plug 11 is disposed in the plug hole 9 and a tip end portion of the ignition plug 11 faces the combustion chamber 3. The ignition plug 11 is inclined such that a tip end side of the ignition plug 11 is positioned close to the injector 10, an ignition coil unit (not shown) is connected to a base end side (upper end side) of the ignition plug 11, and an electrical current flows into each cylinder 1 at a predetermined time. Accordingly, the ignition plug 11 can ignite an air-fuel mixture of fuel that is injected from the injector 10 as described above and intake air from the intake ports 6.

Engine Cooling System

As illustrated in FIG. 1, the cylinder head 4 is provided with a water jacket 40 for cooling the top portion of the combustion chamber 3, the intake ports 6, the exhaust ports 7, and the like for each cylinder 1. That is, as described above, the cylinder head 4 is assembled with the upper portion of the cylinder block 5 and as schematically illustrated in FIG. 2, an upper water jacket 40*a* and a lower water jacket 40*b* are formed in the cylinder head 4. In addition, the cylinder block 5 is provided with a water jacket 50 such that the water jacket 50 surrounds the vicinity of the cylinder 1.

Although not illustrated, coolant is supplied from an external radiator to the water jacket 50 on the cylinder block 5 side via a water hose. The coolant is forcibly fed into the water jacket 50 by a water pump 51 and flows inside the water jacket 50. Thereafter, the coolant flows upwards after flowing out via a plurality of coolant outlets that is opened on an upper surface of the cylinder block 5. A portion of the coolant flowing through the water jacket 50 is also supplied to an oil cooler.

As illustrated in FIG. 1, a head gasket 12 is disposed on contact surfaces between the cylinder head 4 and the cylinder block 5 and is provided with a plurality of communication holes 12*a* such that the coolant outlets on the cylinder block 5 side communicate with a plurality of coolant inlets 40*c*, 40*d* of the water jacket 40 that is opened on the lower surface of the cylinder head 4. Therefore, the coolant that flows out via the coolant outlets of the cylinder block 5 as described above flows into the lower water jacket 40*b* via the coolant inlets 40*c*, 40*d* of the cylinder head 4.

In the embodiment, the lower surface of the cylinder head 4 is provided with the coolant inlets 40*c*, 40*d* that are respectively disposed on the intake side and the exhaust side. The coolant inlets 40*c* on the intake side are provided between the cylinders 1 and are also provided between the intake ports 6 for each cylinder 1 as described below in detail. Similarly, the coolant inlets 40*d* on the exhaust side are provided between the cylinders 1 and are provided between the exhaust ports 7 for each cylinder 1.

The coolant inlets 40*c*, 40*d* between the cylinders 1 are opened toward coolant paths between the cylinders 1 that constitute a portion of the lower water jacket 40*b*. Coolant flowing into the coolant paths flows obliquely upwards such that the coolant is directed to the vicinity of the center of the cylinder head 4 in a width direction of the cylinder head 4 (direction orthogonal to longitudinal direction of cylinder head 4 and to direction along cylinder central line X) and flows into the upper water jacket 40*a*.

The upper water jacket 40*a* extends in the longitudinal direction of the cylinder head 4 and coolant flows out via the coolant outlets and is directed toward the radiator after flowing from one side of the upper water jacket 40*a* (left side in FIG. 2) to the other side of the upper water jacket 40*a* (right side in FIG. 2). In the embodiment, the upper water jacket 40*a* is inclined toward the exhaust side of the cylinder head 4 as illustrated in FIG. 1 and is formed to surround the exhaust ports 7.

The coolant inlets 40*c*, 40*d* are respectively opened between the intake ports 6 and the exhaust ports 7 for each cylinder 1 and the coolant inlets 40*c*, 40*d* communicate with first and second coolant paths 41, 42 that constitute a portion of the lower water jacket 40*b*. Coolant flows toward the vicinity of the center of the top portion of the combustion chamber 3, that is, in the width direction (right-left direction in FIG. 1) of the cylinder head 4, through the first and second coolant paths 41, 42.

Figure 3:
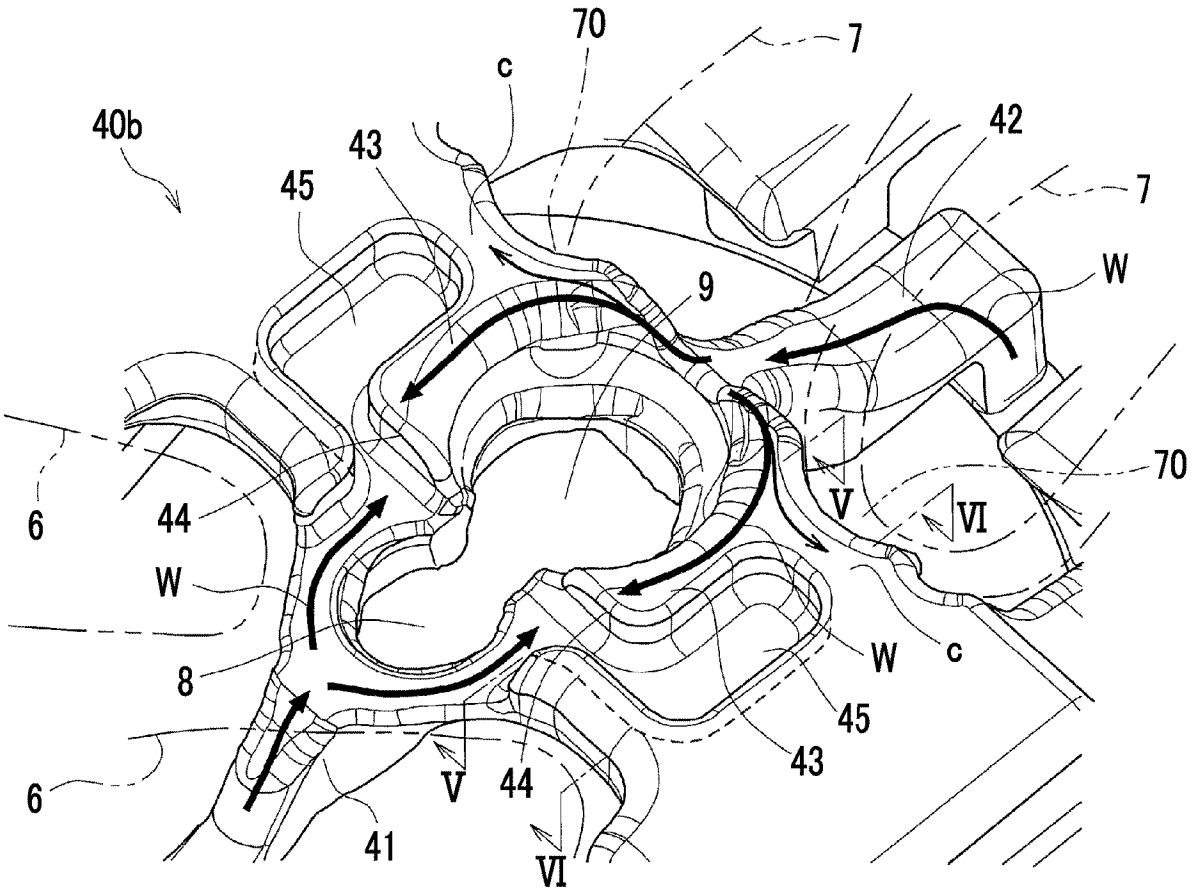
FIG. 3 is a perspective view as seen from obliquely above that illustrates the cylinder head in a see-through manner and that illustrates the shape of a water jacket in the cylinder head.

Specifically, as illustrated in FIG. 3 in which the cylinder head 4 is illustrated in a see-through manner and the water jacket 40 (particularly lower water jacket 40*b*) in the vicinity of the cylinder 1 is seen from obliquely above, on the intake side which is the front-left side in FIG. 3, the first coolant path 41 is provided to extend from a position between the intake ports 6 (represented by virtual line) toward the injector 10. On the exhaust side which is the rear-right side in FIG. 3, the second coolant path 42 is provided to extend from a position between the exhaust ports 7 toward the ignition plug 11.

As illustrated in FIG. 1, the first coolant path 41 is curved upwards and is curved around the top portion of the combustion chamber 3 for each cylinder 1, that is, the recess on the lower surface of the cylinder head 4 after linearly extending toward the center of the cylinder 1 (toward right side in FIG. 1) from the coolant inlet 40*c* on the intake side through a space between the intake ports 6 with the height of the first coolant path 41 staying the same. The downstream side portion of the first coolant path 41 curved upwards as described above branches into two branches to surround the injector hole 8.

Similarly, the second coolant path 42 is curved upwards and is curved around the top portion of the combustion chamber 3 for each cylinder 1 after linearly extending toward the center of the cylinder 1 (toward left side in FIG. 1) from the coolant inlet 40*d* on the exhaust side through a space between the exhaust ports 7. The dimension of the second coolant path 42 curved upwards as described above in a height direction (vertical direction) gradually increases and the downstream side portion of the second coolant path 42 branches into two branches to surround the plug hole 9.

That is, each of the downstream side portions of the first and second coolant paths 41, 42 branches into two branches to surround the injector 10 or the ignition plug 11 in the vicinity of the center of the cylinder 1 and downstream side ends of the first and second coolant paths 41, 42 join each other (hereinafter, portion in which downstream side portions of first and second coolant paths 41, 42 branch and downstream side ends of first and second coolant paths 41, 42 join each other will be referred to as junction 43). In the junction 43, as represented by arrows W in FIGS. 1 and 3, coolant from the intake side that flows through the first coolant path 41 cools the vicinity of the injector 10, coolant from the exhaust side that flows through the second coolant path 42 cools the vicinity of the ignition plug 11, and the two flows of coolant join each other.

In the embodiment, as is apparent from FIG. 3, the sectional area of the second coolant path 42 on the exhaust side is larger than that of the first coolant path 41 on the intake side. This is for enlarging the amount of coolant flowing through the second coolant path 42 from the exhaust side such that the exhaust side to which a relatively high thermal load is applied can be sufficiently cooled with coolant having a relatively high temperature in consideration of the fact that the temperature of coolant in the water jacket 50 on the cylinder block 5 side is higher on the exhaust side than that on the intake side.

Flow of Coolant in Junction

As described above, coolant flows into the first and second coolant paths 41, 42 from the water jacket 50 in the cylinder block 5 via the coolant inlets 40*c*, 40*d* below the first and second coolant paths 41, 42. The coolant flows into the first and second coolant paths 41, 42 while flowing upwards as represented by the arrows W in FIGS. 1 and 3 and flows obliquely upwards along the curved shapes of the first and second coolant paths 41, 42. Therefore, a flow of coolant is likely to be one-sided toward an upper side in the junction 43.

Figure 4:
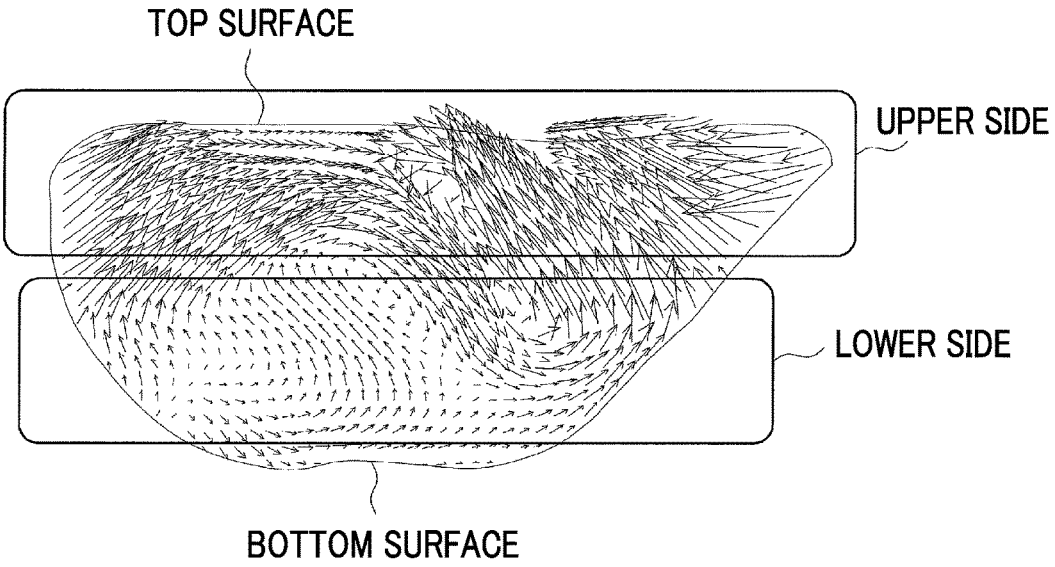
FIG. 4 is an explanatory diagram that illustrates an example of a flow field of coolant in a junction pertaining to a case where a facing wall or the like is not provided.

For example, FIG. 4 illustrates an example of a flow field of coolant in the junction 43 pertaining to a case where a facing wall 44 or the like which will be described later is not provided. The example is the result of a simulation performed by the present inventors and it can be understood that flows of coolant from the intake side and the exhaust side (left side and right side in FIG. 4) collide with each other while being one-sided toward the upper side in the junction 43 and the intensity of coolant flow is weak and the coolant is stagnant on a lower side in the junction 43.

When the flows of coolant from the intake side and the exhaust side collide with each other on the upper side in the junction 43, a major portion of the flows is divided into right and left sides (into right and left sides with respect to flowing direction (to front and rear sides in FIG. 4)) and flows in the longitudinal direction of the cylinder head 4. Accordingly, the major portion of the flows of coolant is unlikely to reach a bottom surface of the junction 43 that is most desired to be cooled. Therefore, knocking is likely to occur since the vicinity of the center of the combustion chamber 3 of which the temperature is likely to become relatively high cannot be efficiently cooled and there is a possibility that a deposit becomes likely to be accumulated in an injection hole of the injector 10 since the temperature of the injector 10 becomes relatively high.

Figure 5:
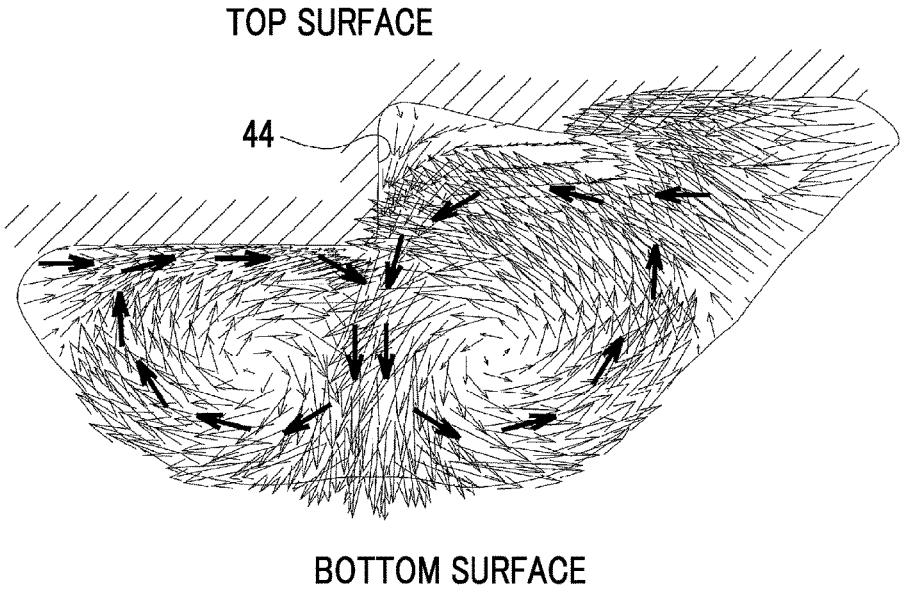
FIG. 5 is a diagram corresponding to FIG. 4 in the embodiment and illustrates a flow field in a section taken along line V-V in FIG. 3.

With regard to this, in the embodiment, as illustrated in FIG. 5, a top surface of the junction 43 is formed such that an intake side portion (left side in FIG. 5) of the top surface becomes lower than an exhaust side portion (right side in FIG. 5) of the top surface and a flow of coolant flowing through the second coolant path 42 from the exhaust side collides with an exhaust side surface of a side wall 44 that connects the intake side portion and the exhaust side portion to each other. FIG. 5 illustrates the result of the same simulation as FIG. 4 and illustrates a flow field in a section taken along line V-V in FIG. 3, that is, in a space between a guiding wall 45 and the ignition plug 11.

As illustrated in FIG. 5, it can be understood that a flow of coolant from the exhaust side is directed downwards after colliding with the exhaust side surface of the side wall 44 of a stepped portion of the top surface on the upper side in the junction 43. That is, the side wall 44 of the stepped portion is a facing wall (hereinafter, referred to as facing wall 44) that faces a flow of coolant from the exhaust side. In the embodiment, a flow of coolant from the exhaust side is directed downwards after colliding with the facing wall 44 and a flow of coolant from the intake side is also directed downwards while being involved in the downward flow.

That is, a flow of coolant from the exhaust side from which a larger amount of coolant flows in comparison with the intake side is reliably directed downwards with the facing wall 44 and a flow of coolant from the intake side, which is the opposite side to the exhaust side, is directed downwards while being involved in the flow of coolant from the exhaust side. Therefore, it is possible to suppress a turbulent flow or a stagnant flow that occurs when the opposite flows directly collide with each other and it is possible to efficiently cool the bottom surface of the junction 43 with flows of coolant reaching the bottom surface of the junction 43 by directing the flows of coolant from both of the intake side and the exhaust side downwards.

In the embodiment, as illustrated in FIG. 3, a portion (at least portion) of the junction 43 that corresponds to the ignition plug 11 and is on the exhaust side is provided with the guiding wall 45 that extends in the width direction of the cylinder head 4 such that the guiding wall 45 surrounds the ignition plug 11 from the opposite sides in the longitudinal direction of the cylinder head 4 (that is, sides opposite to injector 10 or ignition plug 11). Accordingly, a flow of coolant from the exhaust side is guided toward the facing wall 44.

The guiding wall 45 is also provided to extend downwards from the top surface of the junction 43 and an intake side end portion of the guiding wall 45 (that is, end portion on downstream side in direction in which coolant flows) is connected to the facing wall 44. In FIG. 3, since the cylinder head 4 is illustrated in a see-through manner and particularly the lower water jacket 40*b* in the vicinity of the cylinder 1 is seen from obliquely above, the facing wall 44 or the guiding wall 45 appears to be a recess on the top surface of the junction 43.

A flow of coolant guided toward the facing wall 44 by the guiding wall 45 is effectively directed downwards without escaping to the right and left sides (right and left sides with respect to flowing direction) from a space between the facing wall 44 and the guiding wall 45 after colliding with the facing wall 44 as described above. Since the downward flow is formed as described above, in the junction 43, a downward flow is formed at a portion other than a portion in which a flow of coolant from the exhaust side collides with the facing wall 44.

Figure 6:
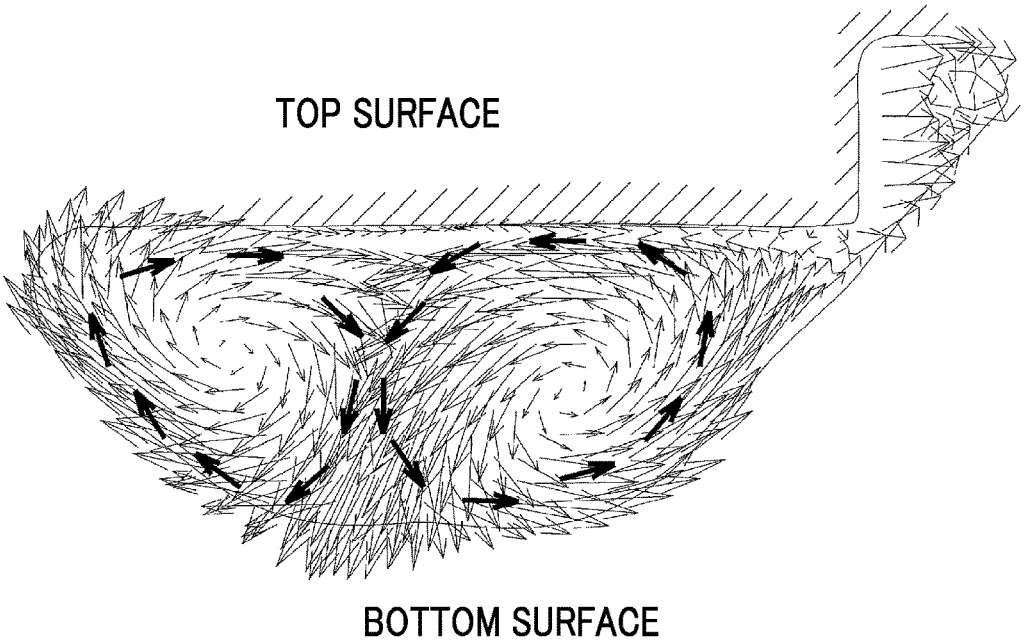
FIG. 6 is a diagram corresponding to FIG. 4 in the embodiment and illustrates a flow field in a section taken along line VI-VI in FIG. 3.

FIG. 6 illustrates a flow field in a section taken along line VI-VI in FIG. 3 and it can be understood that an intensive downward flow is formed between the guiding wall 45 and the ignition plug 11 in FIG. 5 and below the guiding wall 45 such that the coolant reaches the bottom surface of the junction 43. When a flow of coolant reaches the bottom surface of the junction 43 over a wide range as described above, it is possible to efficiently cool the combustion chamber 3 side of which the temperature is likely to become relatively high.

However, when a flow of coolant from the exhaust side is guided toward the facing wall 44 by the guiding wall 45 and is restrained from escaping to right and left sides by being surrounded by the facing wall 44 and the guiding wall 45, there is a possibility of having an increase in pressure loss and an increase in drive load applied to the water pump 51. Therefore, in the embodiment, a gap c is formed between an exhaust side end portion of the guiding wall 45 (that is, end portion on upstream side in direction in which coolant flows) and a peripheral wall 70 (represented by virtual lines) of the nearby exhaust port 7.

As a result, as represented by thin arrows in FIG. 3, a portion of a flow of coolant from the exhaust side that flows through the second coolant path 42 and reaches the junction 43 flows through the gap c between the guiding wall 45 and the peripheral wall 70 along the peripheral wall 70 of the exhaust port 7 to flow in the longitudinal direction of the cylinder head 4. Since a portion of a flow of coolant escapes as described above, it is possible to further suppress the increase in pressure loss.

Therefore, in the cylinder head of the engine according to the embodiment, coolant flows through the first coolant path 41 on the intake side and the second coolant path 42 on the exhaust side toward the injector 10 or the ignition plug 11 disposed in the vicinity (vicinity of cylinder central line X) of the center of each cylinder 1 and thus it is possible to efficiently cool the injector 10 and the ignition plug 11 in the junction 43 in which each of the first and second coolant paths 41, 42 branches into two branches and the first and second coolant paths 41, 42 join each other.

In addition, in the junction 43 in which flows of coolant from the intake side and the exhaust side join each other as described above, the intake side portion of the top surface of the junction 43 is lower than the exhaust side portion of the top surface and a flow of coolant from the exhaust side is directed downwards after colliding with the facing wall 44 formed on the stepped portion of the top surface. A flow of coolant from the intake side is involved in the flow of coolant from the exhaust side and a flow of coolant reaching the bottom surface of the junction 43 is formed. Therefore, it is possible to efficiently cool the vicinity of the center of the combustion chamber 3 side of which the temperature is likely to become relatively high.

Furthermore, since the guiding wall 45 that guides a flow of coolant from the exhaust side to the facing wall 44 is provided and the intake side end portion of the guiding wall 45 is connected to the facing wall 44, it is possible to enlarge the amount of coolant from the exhaust side that collides with the facing wall 44 and it is possible to enlarge the amount of coolant directed downwards since a flow of coolant is restrained from escaping to the right and left sides by being surrounded by the facing wall 44 and the guiding wall 45.

Particularly, in the embodiment, since the sectional area of the second coolant path 42 on the exhaust side is larger than that on the intake side and the amount of coolant flowing from the exhaust side is large, the intensity of a flow of coolant from the exhaust side that is directed downwards after colliding with the facing wall 44 as described is increased. Therefore, it is possible to more reliably form a flow of coolant reaching the bottom surface of the junction 43 in which a flow of coolant from the intake side is involved.

A portion of a flow of coolant from the exhaust side of which the amount is large as described above escapes from the gap c between the exhaust side end portion of the guiding wall 45 and the peripheral wall 70 of the nearby exhaust port 7. Accordingly, it is possible to further suppress an increase in pressure loss. Therefore, it is possible to favorably achieve an improvement in cooling properties with respect to the combustion chamber 3 side and to suppress an increase in pressure loss accompanying the improvement in cooling properties at the same time by appropriately adjusting the size of the gap c.

Other Embodiment

The above-described embodiment is merely an example and is not intended to limit the configuration and the purpose of use of the aspect. For example, in the embodiment, as illustrated in FIG. 3, in the junction 43 of the first and second coolant paths 41, 42, the guiding wall 45 is provided to be connected to the facing wall 44. However, the aspect is not limited to this. The facing wall 44 and the guiding wall 45 may not be connected to each other and the guiding wall 45 may not be provided.

In the embodiment, as illustrated in FIGS. 1, 3, and 5, in the junction 43 of the first and second coolant paths 41, 42, the intake side portion of the top surface is lower than the exhaust side portion of the top surface and a flow of coolant from the exhaust side collides with the side wall (facing wall 44) that connects the intake side portion and the exhaust side portion. However, the aspect is not limited to this.

Figure 7:
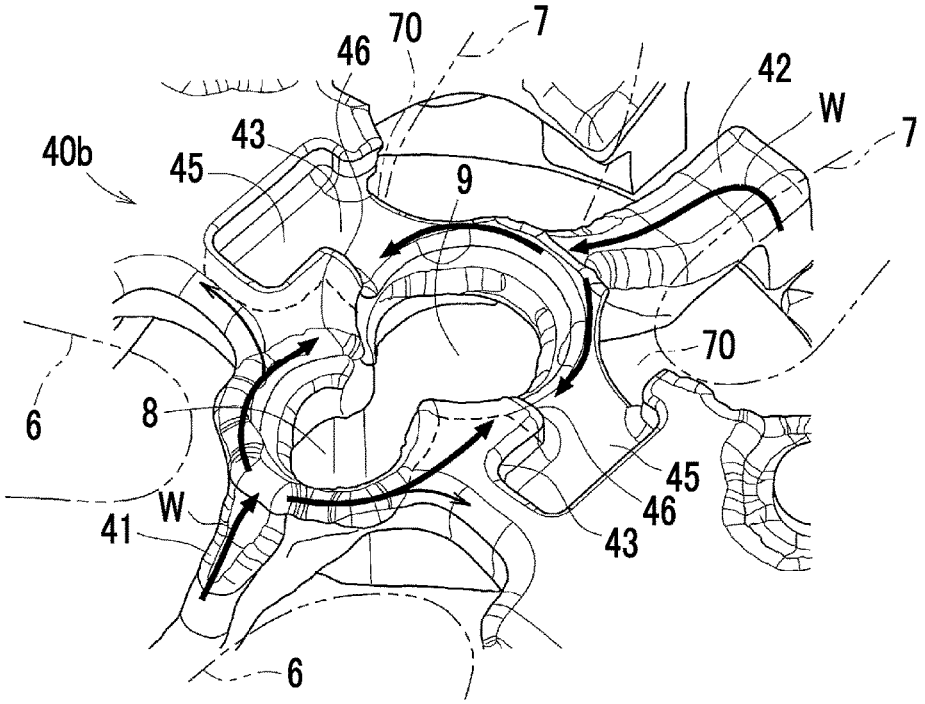
FIG. 7 is a view according to another embodiment in which a facing wall is provided such that a flow of coolant from an intake side collides with the facing wall and is a view corresponding to FIG. 3.

That is, for example, as illustrated in FIG. 7, the exhaust side portion of the top surface of the junction 43 may be lower than the intake side portion of the top surface such that a flow of coolant from the intake side collides with a facing wall 46 that is a side wall connecting the intake side portion and the exhaust side portion. In this case, since a flow of coolant from the intake side of which the coolant temperature is lower than a flow of coolant from the exhaust side is more reliably directed downwards, there is a possibility of an increase in cooling effect with respect to the bottom surface of the junction 43.

In this case, it is preferable that the guiding wall 45 is provided as illustrated in FIG. 7 such that a flow of coolant from the intake side is guided toward the facing wall 46 and it is preferable that the exhaust side end portion of the guiding wall 45 is connected to the facing wall 46. However, the aspect is not limited to this. The guiding wall 45 and the facing wall 46 may not be connected to each other and the guiding wall 45 may not be provided.

Figure 8:
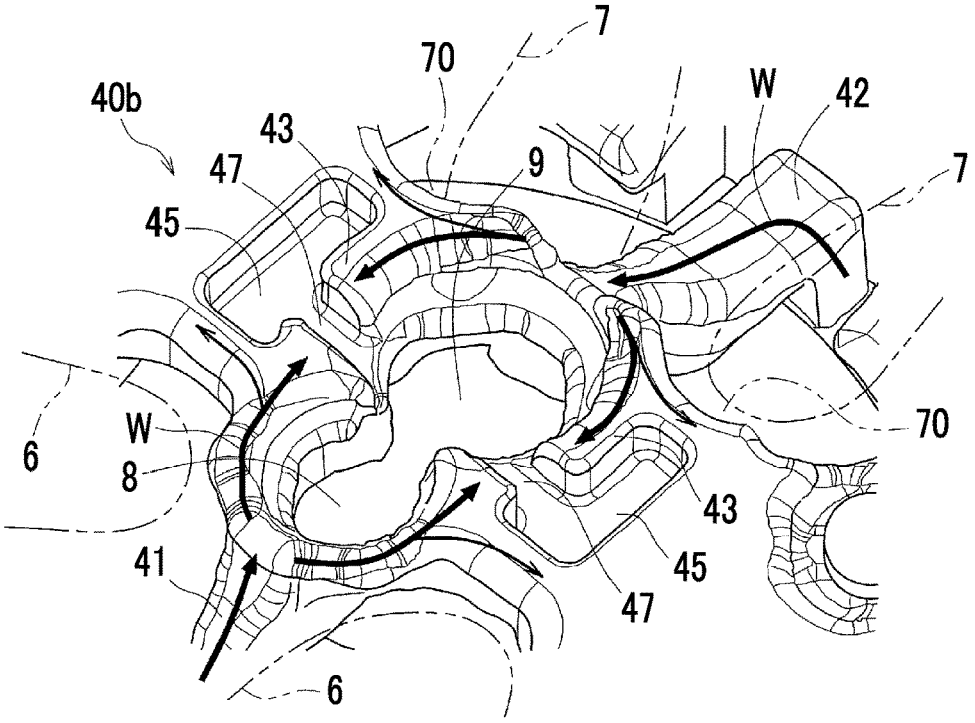
FIG. 8 is a view according to still another embodiment in which a facing wall is provided such that flows of coolant from both of an intake side and an exhaust side collide with the facing wall and is a view corresponding to FIG. 3.

For example, as illustrated in FIG. 8, the heights of the exhaust side portion and the intake side portion of the top surface of the junction 43 may not be different from each other and a facing wall 47 may be provided to be hung down from an intermediate portion between the intake side and the exhaust side such that flows of coolant from the intake side and the exhaust side respectively collide with both of the side surfaces on the intake side and the exhaust side. In this case, flows of coolant from both sides are more reliably directed downwards by the facing wall 47.

In this case also, it is preferable that the guiding wall 45 is provided in the same manner as in the embodiment or in the same manner as illustrated in FIG. 7 such that flows of coolant from both of the intake side and the exhaust side are guided toward the facing wall 47 and it is preferable that an intermediate portion of the facing wall 47 is connected to the guiding wall 45. However, the aspect is not limited to this. The guiding wall 45 and the facing wall 47 may not be connected to each other and the guiding wall 45 may not be provided.

Figure 9:
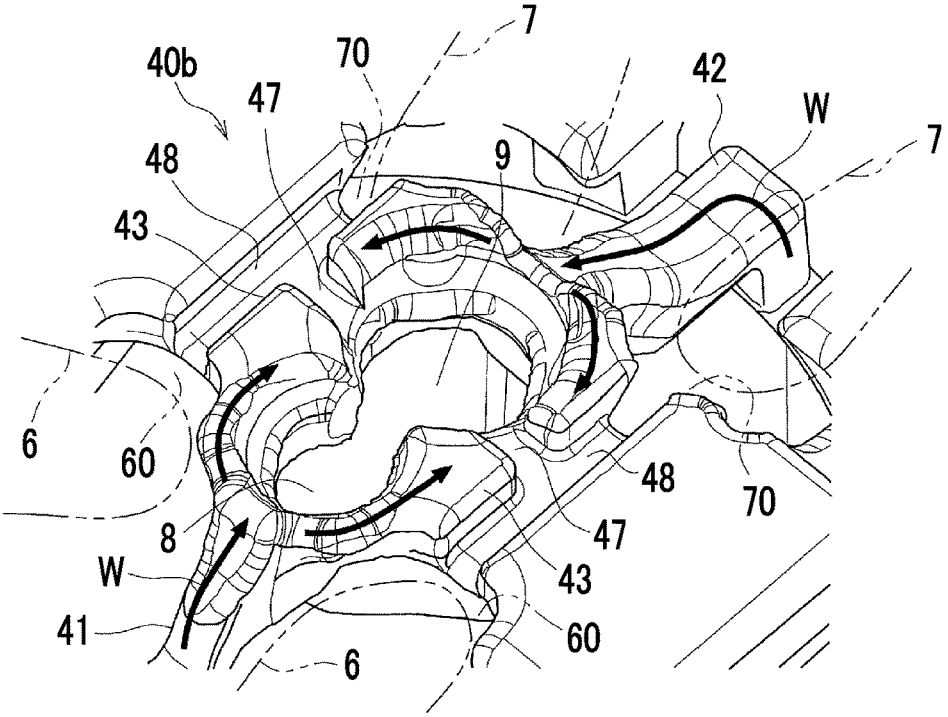
FIG. 9 is a view according to still another embodiment in which a guiding wall is connected to a port peripheral wall and is a view corresponding to FIG. 3.

In the embodiment, as illustrated in FIG. 3, the gap c is formed between the exhaust side end portion of the guiding wall 45 and the peripheral wall 70 of the nearby exhaust port 7. However, the aspect is not limited to this. That is, as illustrated in FIG. 9 which illustrates a modification example of the configuration illustrated in FIG. 8, a guiding wall 48 may be provided to extend over a space from a peripheral wall 60 of the intake port 6 to the peripheral wall 70 of the exhaust port 7. In this case, the guiding wall 48 is stretched like a beam between the intake port 6 and the exhaust port 7 that face each other in the water jacket 40 and thus it is possible to further improve the hardness of the cylinder head 4.

In the embodiment, an example in which the aspect is applied to a gasoline engine installed in a vehicle has been described. However, the aspect is not limited to this and the aspect can be applied to a cylinder head of a spark-ignition type engine in which alcohol fuel is used, a gas engine, a diesel engine, and the like and can be applied to a cylinder head of an engine other than an engine for a vehicle.

According to the aspect, it is possible to efficiently cool the vicinity of the center of a cylinder in a cylinder head of an engine to which a relatively high thermal load is applied and to further improve the reliability. Therefore, the aspect is preferably applied to an engine for a vehicle.

What is claimed is:

1. A cylinder head comprising:

a pair of intake ports and a pair of exhaust ports opened toward a combustion chamber for each of cylinders in an engine, the intake ports and the exhaust ports being disposed to face each other and the intake ports and the exhaust ports being disposed to surround a fuel injection valve;

a first coolant path through which coolant flows from a position between the intake ports toward the fuel injection valve, the first coolant path being branched into first branch portions to surround the fuel injection valve;

a second coolant path through which coolant flows from a position between the exhaust ports toward the fuel injection valve, the second coolant path being branched into second branch portions to surround the fuel injection valve; and a junction in which a first downstream side portion of each of the first branch portions of the first coolant path and a second downstream side portion of a corresponding one of the second branch portions of the second coolant path join each other, the junction including a facing wall that extends from a top surface of the junction toward the combustion chamber disposed on a lower side of the top surface of the junction, the facing wall facing a flow of coolant in at least one of the first branch portion of the first coolant path and the second branch portion of the second coolant path so as to guide the flow of coolant to reach a bottom surface of the junction.

2. The cylinder head according to claim 1, wherein the junction of the first branch portion of the first coolant path and the second branch portion of the second coolant path includes a guiding wall, the guiding wall surrounding at least a portion of the junction from a side opposite to the fuel injection valve side, and the guiding wall guiding the flow of coolant in at least one of the first branch portion of the first coolant path and the second branch portion of the second coolant path toward the facing wall.

3. The cylinder head according to claim 2, wherein the guiding wall is provided to extend downwards from the top surface of the junction and a downstream side end portion of the guiding wall that is positioned on a downstream side in a direction in which coolant in at least one of the first branch portion of the first coolant path and the second branch portion of the second coolant path flows is connected to the facing wall.

4. The cylinder head according to claim 3, wherein a gap is defined between an upstream side end portion of the guiding wall that is on a side opposite to the downstream side end portion side and a peripheral wall of the intake port or the exhaust port, and the coolant flows in the gap along the peripheral wall.

5. The cylinder head according to claim 1, wherein a sectional area of the second branch portion of the second coolant path in the junction is larger than a sectional area of the first branch portion of the first coolant path in the junction.

6. The cylinder head according to claim 1, wherein:

an intake side portion of the top surface of the junction is lower than an exhaust side portion of the top surface of the junction; and the facing wall is a side wall that connects the intake side portion and the exhaust side portion and that faces the flow of coolant in the second coolant path.

7. The cylinder head according to claim 1, wherein an intake side portion of the top surface of the junction is higher than an exhaust side portion of the top surface of the junction.

8. The cylinder head according to claim 1, wherein:

heights of an intake side portion of the top surface of the junction and an exhaust side portion of the top surface of the junction are not different from each other; and the facing wall is provided to be hung down from an intermediate portion between an intake side and an exhaust side.

* * * * *